US006360677B1

(12) United States Patent
Robillard et al.

(10) Patent No.: US 6,360,677 B1
(45) Date of Patent: Mar. 26, 2002

(54) INJECTOR FOR A BURNER AND CORRESPONDING INJECTION SYSTEM

(75) Inventors: Dominique Robillard; Thierry Borissoff; Celso Zerbinatti; Dora Sophia Alves; Jacques Dugue, all of Paris Cedex (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/468,110

(22) Filed: Dec. 21, 1999

(30) Foreign Application Priority Data

Dec. 30, 1998 (FR) ..... 98 16633

(51) Int. Cl.[7] ..... F23D 11/16; F23C 1/02; F23C 1/04; F23C 7/00

(52) U.S. Cl. ..... 110/260; 110/262; 239/424; 239/427.5; 239/422; 431/187; 431/154

(58) Field of Search ..... 239/405, 406, 239/419.3, 424, 427.5, 419, 422, 400, 403; 110/260, 262; 431/187, 183, 184, 182, 186, 154

(56) References Cited

U.S. PATENT DOCUMENTS

| | | | | | |
|---|---|---|---|---|---|
| 872,288 | A | * | 11/1907 | Koons | 239/419 |
| 1,020,348 | A | * | 3/1912 | Gardner | 239/427.5 |
| 1,234,088 | A | * | 7/1917 | Ralston | 239/427.5 |
| 1,679,152 | A | * | 7/1928 | Bowen | 239/419.3 |
| 3,644,076 | A | * | 2/1972 | Bagge | 431/284 |
| 3,733,165 | A | * | 5/1973 | Nakagawa et al. | 431/10 |
| 4,362,274 | A | * | 12/1982 | Davis | 239/419.3 |
| 4,412,808 | A | * | 11/1983 | Sheppard et al. | 431/8 |
| 4,428,727 | A | * | 1/1984 | Deussner et al. | 431/182 |
| 4,523,530 | A | * | 6/1985 | Kaminaka et al. | 110/264 |
| 4,525,175 | A | * | 6/1985 | Stellacccio | 48/86 R |
| 4,544,095 | A | * | 10/1985 | Litzen | 239/8 |
| 4,655,706 | A | * | 4/1987 | Bayh, III | 431/187 |
| 4,946,475 | A | * | 8/1990 | Lipp et al. | 48/86 R |
| 5,044,558 | A | * | 9/1991 | Young et al. | 239/391 |
| 5,092,760 | A | * | 3/1992 | Brown et al. | 431/10 |
| 5,129,333 | A | | 7/1992 | Frederick et al. | |
| 5,129,335 | A | | 7/1992 | Lauwers | |
| 5,178,533 | A | * | 1/1993 | Collenbusch | 431/8 |
| 5,785,721 | A | * | 7/1998 | Brooker | 48/86 R |
| 5,822,992 | A | * | 10/1998 | Dean | 60/737 |
| 5,833,141 | A | * | 11/1998 | Bechtel, II et al. | 239/406 |
| 5,997,595 | A | * | 12/1999 | Yokohoma et al. | 48/86 R |

FOREIGN PATENT DOCUMENTS

| | | |
|---|---|---|
| AT | 315 342 B | 4/1974 |
| EP | 0 449 788 | 10/1991 |
| FR | 1 385 061 | 4/1965 |

* cited by examiner

*Primary Examiner*—Denise L. Esquivel
*Assistant Examiner*—K. B. Rinehart
(74) *Attorney, Agent, or Firm*—Burns, Doane, Swecker & Mathis, L.L.P.

(57) ABSTRACT

An injector for a burner is provided in which assemblies for injecting the main and auxiliary fuels and the oxidizer are arranged radially, one around the other, about a longitudinal axis. The injector has a main-fuel outlet, an oxidizer outlet, and an auxiliary-fuel outlet on the respective assemblies. The injector can be used in incinerator applications, such as in methods for producing clinker.

23 Claims, 3 Drawing Sheets

INJECTOR FOR A BURNER AND CORRESPONDING INJECTION SYSTEM

This application claims priority under 35 U.S.C. §§119 and/or 365 to 98 16633 filed in France on Dec. 30. 1998; the entire content of which is hereby incorporated by reference.

BACKGROUND OF THE INVENTION

1. Field of the Invention

The present invention relates to injectors for burners which have a longitudinal axis and applies in particular to methods for producing clinker, which is an intermediate in the manufacture of cement.

2. Description of the Related Art

Clinker is obtained by firing quarry materials such as clay, limestone, etc. at high temperature.

A distinction is made between three main types of firing for producing clinker, namely firing using the wet process, firing using the semi dry process and firing using the dry process.

In the case of the semi dry and dry processes, the firing installation comprises, in succession, a precalcination device for preheating, dehydrating and decarbonating the raw materials, for example a Lepol grate, and a rotary kiln into which the material flows and where it is turned into clinker. This rotary kiln outputs clinker.

A main blast pipe is located at the outlet of the rotary kiln. This blast pipe supplies the rotary kiln with the required calorific energy. The calorific energy needed to operate the precalcination device is provided mainly by the flue gases produced by the main blast pipe, these flue gases circulating in the rotary kiln against the current of the material. Top-up energy is needed at the precalcination device.

In the case of a Lepol grate, this top-up is usually provided by burning, firstly a main fuel with a high lower calorific value (LCV), for example one higher than 6,000 th/t, and secondly, an auxiliary fuel with a low LCV, for example one below 2,000 th/t.

In general, the main fuel consists of liquid industrial waste containing up to 30% by mass of water and the auxiliary fuel consists of contaminated industrial waste water. To provide the top-up energy in the chamber of the precalcination device, pressurized air is used to atomize these fuels in separate injectors.

The oxygen contained in the flue gases present in the chamber of the precalcination device constitutes the main oxidizer. Top-up oxygen is introduced using a third injector near to the main-fuel injector.

In the precalcination device, the main fuel is atomized in the form of an upper layer, the auxiliary fuel is atomized in the form of a lower layer spaced away from the upper layer, and the top-up oxygen is injected in the form of an intermediate layer located between the other two layers, near the upper layer.

The main and auxiliary fuels and the top-up oxidizer do not mix well because they are injected as parallel layers.

As a result, the combustion efficiency of the fuels that are to be injected is relatively low and it is also found that the consumption of the oxygen present in the flue gases is also relatively low.

What is more, the injection system as a whole is bulky.

The object of the invention is to solve these problems by providing improved injectors which, in methods for producing clinker, allow the combustion efficiency of the fuels to be improved and the bulk reduced.

SUMMARY OF THE INVENTION

To this end, the subject of the invention is an injector for a burner having a longitudinal axis, characterized in that it comprises an assembly for injecting a main fuel, exhibiting a main-fuel outlet, an assembly for injecting an oxidizer, exhibiting an oxidizer outlet, and an assembly for injecting an auxiliary fuel, exhibiting an auxiliary-fuel outlet, and in that the said assemblies for injecting the main and auxiliary fuels and the oxidizer are arranged radially one around the other.

According to particular embodiments, the injector may have one or more of the following features, taken in isolation or any technically feasible combination:

- one or each fuel-injection assembly is an assembly for atomizing the said fuel which comprises means for routing the said fuel, means for routing an atomization fluid, and atomization means connected to the said means for routing the fuel and the atomization fluid;
- for the said or each fuel-atomization assembly, the said means for routing the fuel and the atomization fluid are arranged radially around each other;
- for the said or each fuel-atomization assembly, the means for routing the atomization fluid are arranged around the means for routing the said fuel;
- one or each fuel-injection assembly is mounted in the injector so that it can slide and be adjusted, with respect to the oxidizer-injection assembly, between at least one separated position and one close position, the corresponding fuel outlet and the oxidizer outlet being respectively separated from each other and close together in the said separated and close positions;
- the or each fuel-injection assembly is removable;
- the oxidizer-injection assembly is arranged radially between the assembly for injecting the main fuel and the assembly for injecting the auxiliary fuel;
- the assembly for injecting the fuel with the lower lower calorific value is located radially further towards the outside of the injector than the assembly for injecting the fuel with the higher lower calorific value;
- the assembly for injecting the fuel with the lower lower calorific value is located radially on the outside of the injector;
- the injector comprises means for causing one or each fuel and/or the oxidizer leaving the corresponding injection assembly to rotate about the longitudinal axis of the injector;
- the said rotation-inducing means comprise channels which are in a helical shape with respect to the said longitudinal axis of the injector;
- the said channels make an angle of between about 0 and 30° with the longitudinal axis of the injector;
- the injector comprises an atomization tip which has calibrated orifices and which is mounted downstream of the respective outlets of the assemblies for injecting the main and auxiliary fuels and for injecting the oxidizer; and
- calibrated orifices of the atomization tip define between them, in a longitudinal plane of the injector, an angle of between about 20 and 120°.

Another subject of the invention is a system for injecting main fuel and auxiliary fuel and oxidizer, comprising a source of main fuel, a source of auxiliary fuel, a source of oxidizer, and at least one injector, characterized in that the injector is an injector as described hereinabove and in that the assemblies for injecting the main and auxiliary fuels and the oxidizer of the injector are connected respectively to the sources of main and auxiliary fuel and of oxidizer.

As an alternative, one or each fuel-injection assembly is an assembly for atomizing the said fuel which comprises means for routing the said fuel, means for routing atomization fluid, and atomization means connected to the said means for routing the said fuel and the atomization fluid, and the injection system further comprises at least one source of atomization fluid connected to the said means for routing the atomization fluid of the or each fuel-atomization assembly.

Furthermore, the source of oxidizer may be a source of gas containing between 30 and 100% oxygen.

BRIEF DESCRIPTION OF THE FIGURES OF THE DRAWING

The invention will be better understood from reading the description which will follow, which is given merely by way of example and made with reference to the appended drawings in which.

DETAILED DESCRIPTION OF THE PREFERRED EMBODIMENTS

Figure 1:
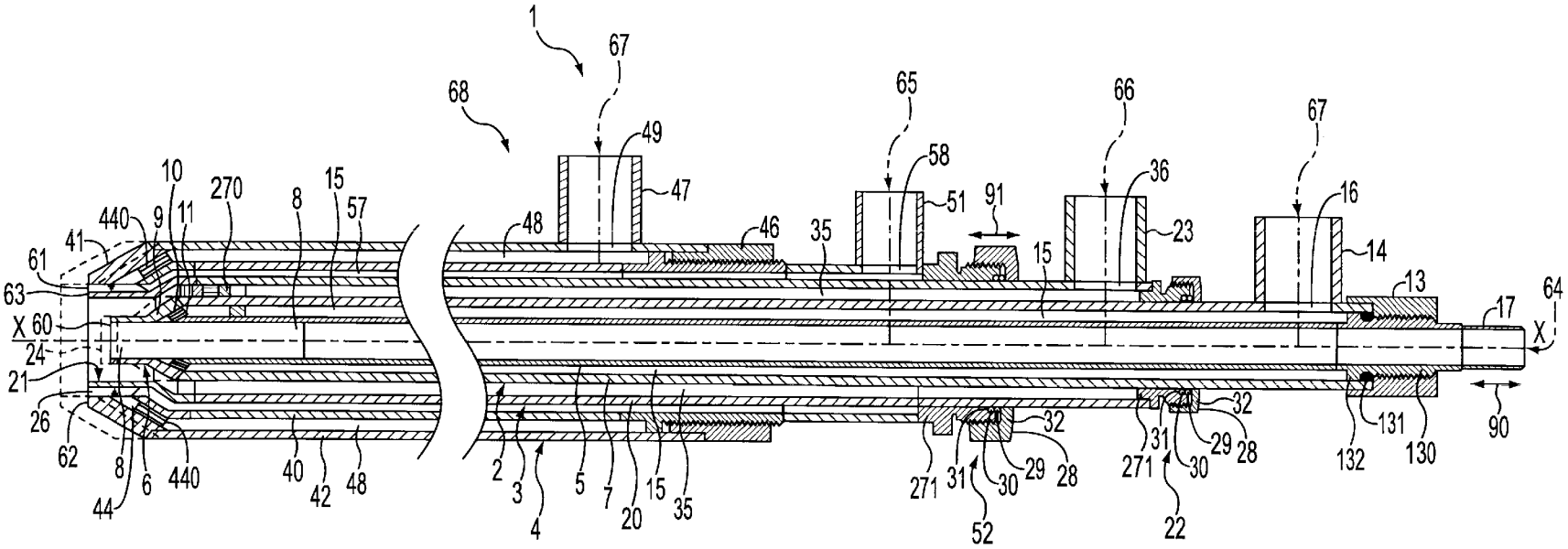
FIG. 1 is a diagrammatic view in longitudinal section of an injector according to the invention.

FIG. 1 illustrates an injector 1 for a method for producing clinker using the semi dry or dry process.

This injector 1 generally elongate and axisymmetric in shape with an axis X-X, essentially comprises an inner assembly 2 for injecting a main liquid fuel with a high LCV, an intermediate assembly 3 for injecting oxidizer and an outer assembly 4 for injecting an auxiliary liquid fuel with a low LCV.

The assemblies 2, 3 and 4 are approximately axisymmetric and coaxial.

The outer injection assembly 4 is arranged radially on the outside of the intermediate injection assembly 3 which is itself located radially on the outside of the inner injection assembly 2.

Figure 2:
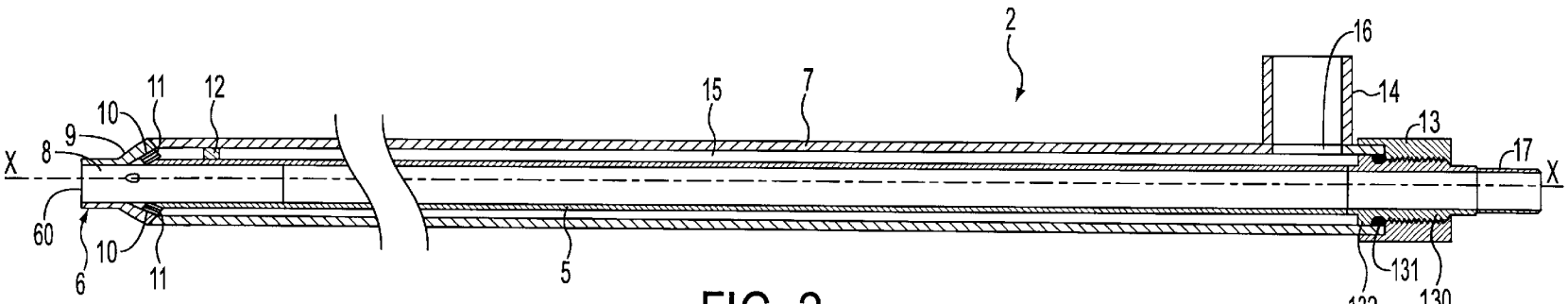
FIGS. 2 to 4 are views similar to FIG. 1, illustrating various constituent elements of the injector of FIG. 1.

As depicted in FIGS. 1 and 2, the assembly 2 for injecting the main fuel essentially comprises an inner tube 5 for routing the main fuel, an atomization head 6 which extends the tube 5 in a forward or downstream direction (to the left in FIGS. 1 and 2), and an outer tube 7 externally surrounding the tube 5.

The head 6 has an axial central bore 8 communicating with the inside of the tube 5 and a frustoconical outer collar 9 pierced with six oblique bores 10 distributed uniformly about the axis X-X. The bores 10 open into the bore 8. These bores 10 have axes which are inclined forwards by the same angle with respect to the axis X-X. Removable adapters 11 with calibrated orifices are inserted into the bores 10.

The head 6 also comprises three pins 12 projecting radially outwards and located axially to the rear (to the right in FIGS. 1 and 2) of the collar 9. These pins 12 are distributed at equal angles with respect to the axis X-X. The front or downstream end of the tube 7 bears, on the one hand, axially on the collar 9 and, on the other hand, radially on the pins 12. Note that the front end of the tube 7 bears on the collar 9 on frustoconical surfaces which are inclined with respect to the axis X-X, which guarantees sealing between the tube 7 and the collar 9.

A ring 13, which is internally threaded and fixed to the rear end of the tube 7, is screwed onto a threaded rear portion 130 of the tube 5. This ring 13, together with the collar 9 and the pins 12, keeps the tube 5 in its longitudinal position and centres it radially with respect to the tube 7. A seal 131 is fitted between the ring 13 and an annular outer shoulder 132 of the tube 5. This shoulder 132 is located in front of the threaded portion 130 of the tube 5.

A transverse tubular coupling 14 is arranged at the rear of the tube 7, slightly forward of the ring 13.

The tubes 5 and 7 delimit between them a passage 15 for routing the atomization fluid, which at the front communicates with the orifices of the adapters 11 and therefore with the bore 8, and which at the rear communicates with the coupling 14 by virtue of an orifice 16 formed in the wall of the tube 7.

The inner tube 5 is extended rearwards by a longitudinal tubular coupling 17.

Figure 3:
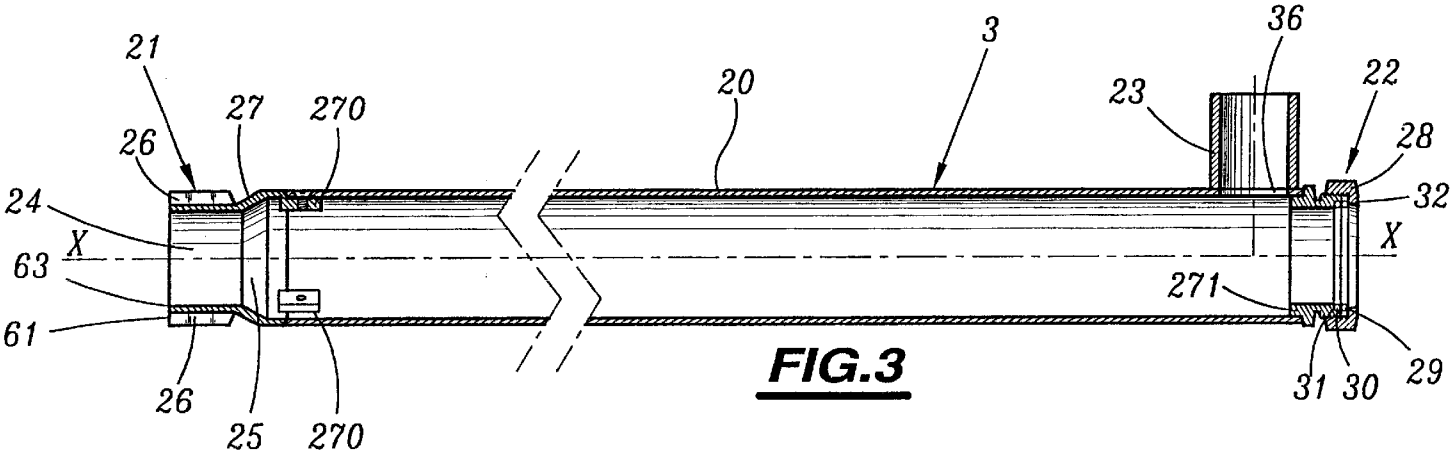

The intermediate assembly 3 for injecting oxidizer essentially comprises (FIGS. 1 and 3), a tube 20, extended forward by an injection head 21 and equipped at the rear with a tightening device 22.

The tube 20 is also equipped with a transverse tubular coupling 23 located slightly forward of the tightening device 22.

The injection head 21 has a central bore 24 communicating with the inside of the tube 20. The bore 24 is of constant cross section except in an intermediate portion 25 where its cross section converges forwards.

Six axial grooves 26 of rectangular cross section, distributed at equal angles about the axis X-X, are formed in the thickness of the head 21.

The grooves 26 are formed radially from the outside of the head 21 and open, on the one hand, into the front edge face of the injection head 21 and, on the other hand, into an outer annular groove 27 of V-shaped cross section and axis X-X, formed in the thickness of the head 21. This outer annular groove 27 is located approximately at the same axial position as the convergent intermediate section 25 of the bore 24.

The head 21 is extended backwards by three interior tabs 270 spaced at equal angles from one another. These tabs 270 are inserted inside the tube 20. These tabs 270, pressed against the wall of the tube 20, each have a transverse screw passing through them for securing the head 21 and the tube 20 together. The front end of the tube 20 bears on the head 21 along frustoconical surfaces which are inclined with respect to the axis X-X, and this guarantees sealing between the tube 20 and the head 21.

The tightening device 22 essentially comprises an end fitting 271 which is externally threaded and secured to the rear end of the tube 20, a nut 28 screwed onto the rear end of the end fitting 271, a split elastic ring 29, a metal washer which is not depicted, and an O-ring 30. The O-ring 30 bears on an inner rear shoulder 31 of the end fitting 271. The metal washer is placed between the O-ring 30 and the split elastic ring 29 and bears on a rear inner annular lip 32 of the nut 28 and the split elastic ring 29.

The assembly 2 for injecting main fuel is arranged so that it can slide along the axis X-X inside the oxidizer-injection assembly 3 as indicated 90. Thus, a passage 35 for routing the oxidizer (FIG. 1) is delimited between the atomization head 6 of the injection assembly 2 and the injection head 21 of the injection assembly 3, and between the tube 7 of the injection assembly 2 and the tube 20 of the injection assembly 3. This passage 35 communicates at the rear with the coupling 23 of the injection assembly 3 via an orifice 36 formed in the wall of the tube 7.

The nut 28 screwed onto the end fitting 271 of the tightening device 22 compresses, via its annular lip 32, the elastic ring 29 and the metal washer, the O-ring 30 which bears on the shoulder 31 of the end fitting 27. Thus, the O-ring 30 is pressed against the exterior surface of the tube 7, thus fixing the axial position of the oxidizer-injection assembly 3 with respect to the fuel-injection assembly 2 and thus guaranteeing sealing between the tubes 7 and 20 at the rear of the injector 1.

The tabs 270 bear radially against the front end of the tube 7 and thus, together with the tightening device 22, centre the assembly 2 for injecting the main fuel inside the oxidizer-injection assembly 3.

Figure 4:
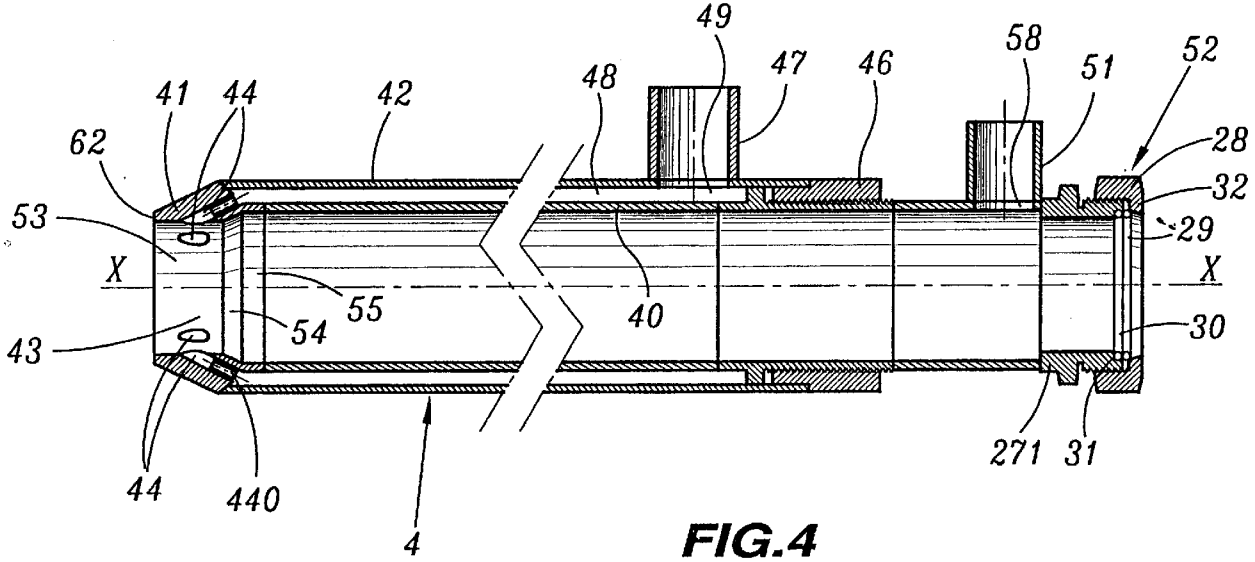

The assembly 4 for injecting the auxiliary fuel essentially comprises (FIGS. 1 and 4) an inner tube 40 for routing the auxiliary fuel, an atomization head 41 which extends the tube 40 forwards, and an outer tube 42 externally surrounding the tube 40.

The head 41 is of frustoconical overall shape converging towards the front. The head 41 has an axial central bore 43 communicating with the inside of the tube 40 and six oblique bores 44 distributed at equal angles about the axis X-X. The bores 44 are inclined forward by the same angle with respect to the axis X-X and communicate with the central bore 43.

Removable adapters 440 with calibrated orifices are inserted into the bores 44. An internally threaded ring 46 secured at the rear end of the tube 42 is screwed onto an intermediate portion of the tube 40. The front end of the tube 42 bears axially on the atomization head 41.

It should be noted that the front end of the tube 42 bears on the head 41 via frustoconical surfaces which are inclined with respect to the axis X-X, thus guaranteeing sealing between the tube 42 and the head 41.

The tube 42 has a transverse tubular coupling 47 located slightly forward of the ring 46.

The tubes 40 and 42 delimit between them a passage 48 for routing the atomization fluid. This passage 48 communicates, on the one hand, with the orifices of the adapters 440 and therefore with the bore 43 and, on the other hand, with the coupling 47, by virtue of an orifice 49 formed in the wall of the tube 42.

The tube 40 is equipped at its rear end with a transverse tubular coupling 51 and then a tightening device 52 similar to the device 22 of the oxidizer-injection assembly 3.

The central bore 43 of the atomization head 41 is delimited by a wall which has a front portion 53 of constant cross section, then an intermediate portion 54 which diverges towards the rear, and finally a rear portion 55 of constant cross section.

The assembly 4 for injecting auxiliary fuel is arranged outside the oxidizer-injection assembly 3, so that it can slide along the axis X-X as indicated by 91.

The portion 53 of the atomization head 41 bears on the front end of the injection head 21 of the oxidizer-injection assembly 3.

The axial grooves 26 of the injection head 21 are placed facing the bores 44 of the atomization head 41 so that these grooves 26 communicate with the orifices of the adapters 440 inserted in the bores 44.

The tubes 20 of the injection assembly 3, and those 40 of the injection assembly 4 delimit between them a passage 57 (FIG. 1) for routing the auxiliary fuel which communicates, on the one hand, at the rear, with the transverse coupling 51 by virtue of an orifice 58 formed in the wall of the tube 40 and, on the other hand, at the front, with the outer annular groove 27 of the injection head 21 and therefore with the axial grooves 26 of this head 21.

Incidentally, as was the case with the tightening device 22, the O-ring 30 of the tightening device 52 is compressed axially to bear radially on the outer surface of the tube 20. Thus, the oxidizer-injection assembly 3 is centred in the assembly 4 for injecting auxiliary fuel and the relative axial position of these assemblies 3 and 4 is fixed.

In FIG. 1, the front edge face 60 of the atomization head 6 of the injection assembly 2 is located axially slightly to the rear of the front end face 61 of the injection head 21 of the injection assembly 3. Furthermore, the edge face 61 of the injection head 21 is located roughly at the same axial position as the front edge face 62 of the atomization head 41 of the injection assembly 4. The front edge faces 60, 61 and 62 axially delimit the outlets of the heads 6, 21 and 41; these respective outlets will bear the same references as the corresponding edge faces 60, 61 and 62.

The injector 1 of FIG. 1 is intended to be arranged in the wall of a precalcination device, for example a Lepol grate.

A source 64 of liquid industrial waste under pressure is then coupled to the axial coupling 17 to supply the main fuel. This waste has an LCV typically of between 6000 th/t and 10000 th/t. A source 65 of contaminated industrial waste water with a low LCV is coupled to the transverse coupling 51 to supply the auxiliary fuel. A source 66 of pressurized oxygen is coupled to the transverse coupling 23 to supply the oxidizer, and a source 67 of pressurized air is coupled to the transverse couplings 14 and 47 to supply the atomization fluids.

The injector 1 and the sources 64 to 67 thus form an injection system 68.

In operation, air introduced by the coupling 14 in the passage 15 mixes, having passed through the orifices of the adapters 11, with the main fuel of high LCV at the atomization head 6, atomizing this fuel. Main fuel is ejected from the outlet 60 of the head 6 in a divergent jet of very fine droplets. This jet strikes the interior edge 63 of the edge face 61 of the injection head 21 of the oxidizer-injection assembly 3.

The oxygen introduced into the coupling 23 flows along the passage 35. This oxygen is then ejected from the head 21 in the form of a jet externally surrounding the jet of main fuel. Because of the shapes and relative arrangements of the atomization head 6 and of the injection head 21, the oxygen passing through the head 21 partially mixes with the jet of main fuel between the outlet 60 of the head 6 and the outlet 61 of the head 21. The mixing between the main fuel and the oxidizer continues as it leaves the outlet 61 of the head 21.

The fuel with the low LCV introduced into the coupling 51 is routed along the passage 57 and then along the axial grooves 26 of the injection head 21. In these axial grooves 26, the fuel with the low LCV meets the pressurized air introduced into the coupling 49 then routed along the passage 48 and the orifices of the adapters 440.

The fuel with the low LCV is thus atomized and leaves the axial grooves 26 in the form of a jet of very fine droplets.

The jet of auxiliary fuel then mixes with the jets of oxygen and of main fuel and a flame is produced.

The flame thus produced at the outlet from the injector 1 makes it possible to achieve good combustion efficiencies of the fuels with the low and with the high LCV and makes it possible to reduce the amount of unburnt substances.

These good efficiencies are due, on the one hand, to the intermediate injection of oxygen which makes it possible to create an oxygen-doped pilot flame within the flame, this creating a central hot spot, and, on the other hand, to the fact that the fuels are atomized into the form of coaxial jets of very fine droplets which become intimately mixed.

Furthermore, it is found that since the fuel with the low LCV travels along the outside of the injector 1, it is not necessary to provide an external cooling system. What happens is that the fuel with the low LCV acts as a coolant, thus protecting the injector 1 and the refractory lining of the precalcination device in which the injector 1 is mounted.

Furthermore, the injector according to the invention is easy to fit and to remove and exhibits extensive scope for adjustment, as will now be described.

By unscrewing the nut 28 of the tightening device 22, the assembly 2 for injecting main fuel can slide freely inside the oxidizer-injection assembly 3. Thus, the position of the outlet 60 of the atomization head 6 with respect to the outlets 61 and 62 of the injection head 21 and of the atomization head 41 may, for example, be altered. By tightening the nut 28 again, the fuel-injection assembly 2 can then be fixed in another position with respect to the oxidizer-injection assembly 3, for example a position in which the outlet 60 is set further back from the outlet 61 or a position in which these outlets 60 and 61 are closer together.

It is also possible, having unscrewed the nut 28, for the assembly 2 for injecting main fuel to be completely removed from the rest of the injector 1. Then, by unscrewing the ring 13, the tube 7 can be backed off with respect to the tube 5 thus giving access to the adapters 11 with calibrated orifices in the atomization head 6 so that these can be cleaned out or exchanged.

Similarly, by unscrewing the nut 28 of the tightening device 52, the position of the oxidizer-injection assembly 3 with respect to the assembly 4 for injecting auxiliary fuel can be altered, or the assembly 3 can even be removed completely from the assembly 4.

It is thus possible, by tightening the nut 28 of the tightening device 52 again, to secure the injection assemblies 3 and 4 in a position in which the outlet 61 of the head 21 is, for example, set back from the outlet 62 of the head 41.

If the assembly 3 is completely removed from the assembly 4, it is possible, by unscrewing the screws of the tabs 270, to change the injection head 21 which extends the tube 20.

Finally, by unscrewing the ring 46, it is possible to back the tube 42 off with respect to the tube 40 in order to clean out or exchange the adapters 440 with calibrated orifices of the atomization head 41.

It is thus possible, with ease, to perform the usual maintenance operations such as cleaning out the orifices through which the various fluids pass and to modify the characteristics of the heads 26, 21 and 41 or the relative positions of their outlets 60, 61 and 62.

In particular, modifying the adapters 11 and 440 makes it possible to set the atomization fluid outlet speeds and therefore to optimize the size of the droplets of the fuel leaving the injector 1.

It is possible to use compressed air, steam or any other fluid as atomization fluid. The mass flow rate of each atomization fluid is preferably between 5 and 20% of the mass flow rate of the corresponding liquid fuel that is to be atomized.

According to an alternative, in place of the common source 67, use is made of two separate sources coupled respectively to the couplings 14 and 47. These two sources may be sources of different atomization fluids.

In the example described, the oxygen injected by the injection assembly 3 is used only as a top-up in order to achieve stoichiometry in the combustion reactions and to dope the flame produced. However, for certain applications, this oxygen injected by the injection assembly 3 may alone provide the stoichiometric quantity for the combustion reactions.

More generally, the oxidizer will be a gas containing between 30 and 100% oxygen.

According to an alternative form which has not been depicted, the grooves 26 may have a helical shape with respect to the axis X-X in order to impart a helical movement to the atomized auxiliary fuel. The angle formed between the grooves 26 and the axis X-X is then preferably between 0 and 30°. This feature makes it possible to further improve the mixing of the fuels and the oxidizer.

Similarly, fins (not depicted) which have a helical shape with respect to the axis X-X may be provided on the outside of the head 6 in front of the collar 9 in order to impart a helical movement to the oxidizer travelling between the atomization head 6 and the injection head 21.

The concentric arrangement of the injector makes it possible to achieve mixing of the atomization jets and satisfactory overall injection with a smaller bulk and, if necessary, high fuel flow rates.

Figure 5:
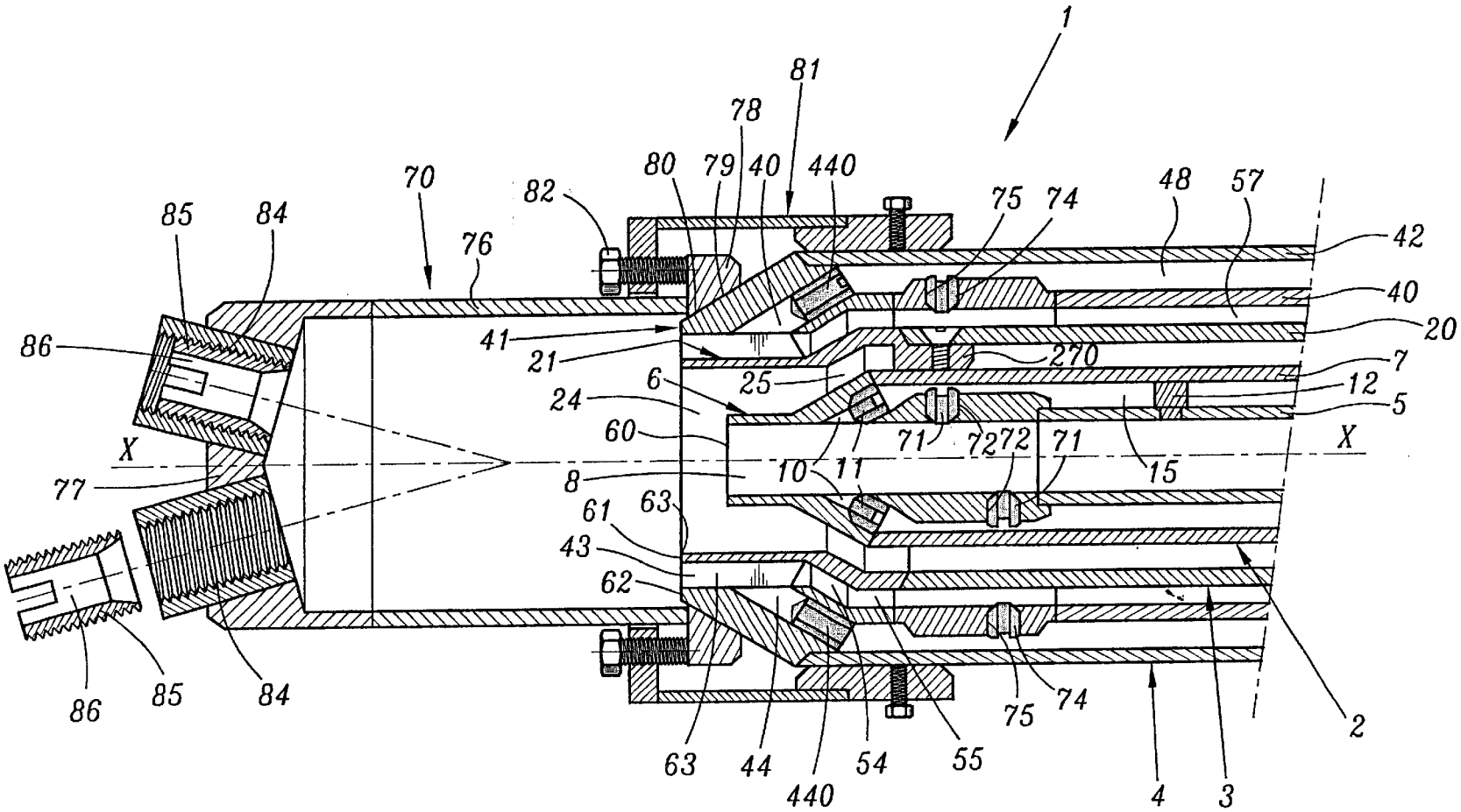
FIG. 5 is an enlarged diagrammatic part view in longitudinal section illustrating the outlet end of an alternative form of the injector of FIG. 1.

FIG. 5 illustrates an alternative form of the injector 1 of FIG. 1, wherein the atomization heads 6 and 41 have been modified and a final atomization tip 70 has been added at the front end of the injector 1.

Adapters 71 with calibrated orifices are now fitted in fourteen transverse bores 72 formed in the wall of the atomization head 6 behind the collar 9. The bores 72 are distributed in two rings of seven bores distributed at equal angles about the axis X-X. The two rings of bores 72 are axially and angularly offset from one another.

The pins 12 are now arranged at the front end of the tube 5.

Likewise, adapters 74 with calibrated orifices are now arranged in fourteen transverse bores 75 formed in the wall of the atomization head 41 behind the convergent section 54 partially delimiting the bore 43 of the head 41.

The bores 74 are distributed in two rows of seven bores distributed at equal angles about the axis X-X. The two rings of bores 74 are axially and angularly offset from one another.

The final atomization tip 70 comprises a tube 76 of axis X-X closed at its front end by a transverse wall 77. The rear end of the tube 76 is extended backwards and radially outwards by a ring 78 of axis X-X, the frustoconical interior surface 79 of which bears on the frustoconical radially outer surface 80 of the atomization head 41. An immobilizing system 81, screwed onto the front end of the tube 42 of the injection assembly 4, presses the ring 78 axially, via axial screws 82, onto the atomization head 41, thus guaranteeing sealing between the outlet of the injector 1 and the final atomization tip 70.

The wall 77 has two oblique bores 84 which are tapped and located in one same plane passing through the axis X-X. Interchangeable adapters 85 with calibrated orifices 86 are screwed into the bores 84. The axes of the bores 84 diverge forward with respect to the axis X-X.

The presence of the adapters 71 and 74 with calibrated drillings gives greater scope for altering the characteristics of the atomization of the main and auxiliary fuels. Specifically, it is possible to plug some of these adapters 71 and 74 or change them to alter the atomization characteristics obtained according to the need.

Furthermore, the atomization tip makes it possible to obtain an overall divergent atomization jet and a greater consumption of the molecules of oxygen contained in the flue gases present in the precalcination device. The angle formed between the axes of the bores 84 and the axis X-X may be between 10 and 60°.

More generally, the injector according to the invention can also be used in the lime-production and dolomite-production industries, and can also be used in industrial waste water incinerators or in radio active waste reprocessing plants.

What is claimed is:

1. An injector for a burner having a longitudinal axis, comprising:

an assembly for injecting a main fuel, exhibiting a main-fuel outlet;

an assembly for injecting an oxidizer, exhibiting an oxidizer outlet; and an assembly for injecting an auxiliary fuel, exhibiting an auxiliary-fuel outlet, and in that the assemblies for injecting the main and auxiliary fuels and the oxidizer are arranged radially one around the other, wherein the injector comprises an atomization tip which has calibrated orifices and which is mounted downstream of the respective outlets of the assemblies for injecting the main and auxiliary fuels and for injecting the oxidizer, and wherein an angle between the calibrated orifices of the atomization tip, in a longitudinal plane of the injector, is between about 20° and 120°.

2. An injector for a burner having a longitudinal axis, comprising:

an assembly for injecting a main fuel, exhibiting a main-fuel outlet;

an assembly for injecting an oxidizer, exhibiting an oxidizer outlet;

an assembly for injecting an auxiliary fuel, exhibiting an auxiliary-fuel outlet;

a source of a main fuel in fluid communication with the assembly for injecting a main fuel, the source of a main fuel including a main fuel having a first calorific value; and a source of an auxiliary fuel in fluid communication with the assembly for injecting an auxiliary fuel, the source of an auxiliary fuel including an auxiliary fuel having a second calorific value which is lower than the first calorific value;

wherein the assemblies for injecting the main and auxiliary fuels and the oxidizer are arranged radially one around the other, and wherein the assembly for injecting the auxiliary fuel is located radially outside of the assembly for injecting a main fuel and of the assembly for injecting an oxidizer.

3. The injector according to claim 2, wherein at least one fuel-injection assembly comprises an assembly for atomizing fuel which comprises:

means for routing fuel;

means for routing atomization fluid; and atomization means connected to the means for routing fuel and to the means for routing atomization fluid.

4. The injector according to claim 3, wherein the means for routing fuel and the means for routing atomization fluid are arranged radially around each other.

5. The injector according to claim 3, wherein the means for routing atomization fluid is arranged around the means for routing fuel.

6. The injector according to claim 2, wherein at least one fuel-injection assembly is slidably and adjustably mounted in the injector with respect to the assembly for injecting an oxidizer, the at least one fuel-injection assembly being movable between at least one separated position and one close position, the outlet of the at least one fuel-injection assembly and the oxidizer outlet being separated from each other and close together in the said separated and close positions, respectively.

7. The injector according to claim 6, wherein the at least one fuel-injection assembly is removable from the injector.

8. The injector according to claim 1, wherein the oxidizer-injection assembly is arranged radially between the assembly for injecting the main fuel and the assembly for injecting the auxiliary fuel.

9. The injector according to claim 2, wherein the injector has a longitudinal axis, and further comprising:

means for causing at least one of the main fuel, the auxiliary fuel, the oxidizer, or combinations thereof to rotate about the longitudinal axis of the injector when injected from the corresponding injection assembly.

10. The injector according to claim 9, wherein the means for causing rotation comprises helical channels with respect to the longitudinal axis of the injector.

11. The injector according to claim 10, wherein the channels make an angle of between about 0° and 30° with the longitudinal axis of the injector.

12. A system for injecting main fuel, auxiliary fuel, and oxidizer, comprising:

a source of oxidizer; and at least one injector according to claim 2;

wherein the assembly for injecting the oxidizer is fluidly connected to the source of oxidizer.

13. The system according to claim 12, wherein at least one fuel-injection assembly comprises an assembly for atomizing fuel which comprises:

means for routing fuel;

means for routing atomization fluid;

atomization means connected to the means for routing fuel and to the means for routing atomization fluid; and at least one source of atomization fluid connected to the means for routing atomization fluid.

14. The system according to claim 12, wherein the source of oxidizer is a source of gas containing between 30% and 100% oxygen.

15. The injector according to claim 3, wherein the at least one fuel-injection assembly is slidably and adjustably mounted in the injector with respect to the assembly for injecting an oxidizer, the at least one fuel-injection assembly being movable between at least one separated position and one close position, the outlet of the at least one fuel-injection assembly and the oxidizer outlet being separated from each other and close together in the said separated and close positions, respectively.

16. The injector according to claim 15, wherein the at least one fuel-injection assembly is removable from the injector.

17. The injector according to claim 3, wherein the injector has a longitudinal axis, and further comprising:

means for causing at least one of the main fuel, the auxiliary fuel, the oxidizer, or combinations thereof to rotate about the longitudinal axis of the injector when injected from the corresponding injection assembly.

18. The injector according to claim 17, wherein the means for causing rotation comprises helical channels with respect to the said longitudinal axis of the injector.

19. The injector according to claim 18, wherein the channels make an angle of between about 0° to 30° with the longitudinal axis of the injector.

20. The system according to claim 13, wherein the source of oxidizer is a source of gas containing between 30% and 100% oxygen.

21. An injector for a burner having a longitudinal axis, comprising:

an assembly for injecting a main fuel, exhibiting a main-fuel outlet;

an assembly for injecting an oxidizer, exhibiting an oxidizer outlet; and an assembly for injecting an auxiliary fuel, exhibiting an auxiliary-fuel outlet, and in that, the assemblies for injecting the main and auxiliary fuels and the oxidizer are arranged radially one around the other, wherein the at least one fuel-injection assembly is an assembly for atomizing the said fuel which comprises means for routing the said fuel, means for routing an atomization fluid, and atomization means connected to the said means for routing the fuel and the atomization fluid, wherein the injector comprises an atomization tip which has calibrated orifices and which is mounted downstream of the respective outlets of the assemblies for injecting the main and auxiliary fuels and for injecting the oxidizer, and wherein an angle between the calibrated orifices of the atomization tip, in a longitudinal plane of the injector, is between about 20° and 120°.

22. An injector for a burner having a longitudinal axis, comprising:

an assembly for injecting a main fuel, exhibiting a main-fuel outlet;

an assembly for injecting an oxidizer, exhibiting an oxidizer outlet; and an assembly for injecting an auxiliary fuel, exhibiting an auxiliary-fuel outlet;

a source of a main fuel in fluid communication with the assembly for injecting a main fuel, the source of a main fuel including a main fuel having a first calorific value; and a source of an auxiliary fuel in fluid communication with the assembly for injecting an auxiliary fuel, the source of an auxiliary fuel including an auxiliary fuel having a second calorific value which is lower than the first calorific value;

wherein the assemblies for injecting the main and auxiliary fuels and the oxidizer are arranged radially one around the other;

wherein at least one fuel-injection assembly comprises an assembly for atomizing fuel which comprises means for routing fuel, means for routing atomization fluid, and atomization means connected to the means for routing fuel and to the means for routing atomization fluid; and wherein the assembly for injecting the auxiliary fuel is located radially outside of the assembly for injecting the main fuel.

23. The injector according to claim 22, wherein the assembly for injecting the auxiliary fuel is located radially on the outside of the injector.

* * * * *